US006598871B2

(12) United States Patent
Ono et al.

(10) Patent No.: US 6,598,871 B2
(45) Date of Patent: Jul. 29, 2003

(54) PAPER-LIKE-PIECE HANDLING APPARATUS

(75) Inventors: Takashi Ono, Tokyo (JP); Mitsugu Mikami, Tokyo (JP)

(73) Assignee: Nippon Conlux Co., Ltd., Tokyo (JP)

( * ) Notice: Subject to any disclaimer, the term of this patent is extended or adjusted under 35 U.S.C. 154(b) by 0 days.

(21) Appl. No.: 09/905,586

(22) Filed: Jul. 12, 2001

(65) Prior Publication Data

US 2002/0060404 A1 May 23, 2002

(30) Foreign Application Priority Data

Jul. 17, 2000 (JP) ..... 2000-215676

(51) Int. Cl.[7] ..... B65H 29/38
(52) U.S. Cl. ..... 271/180
(58) Field of Search ..... 271/180, 181; 194/206, 207

(56) References Cited

U.S. PATENT DOCUMENTS 4,678,072 A 7/1987 Kobayashi et al.
4,784,274 A * 11/1988 Mori et al. ..... 194/206
5,209,335 A * 5/1993 Shuren et al. ..... 194/206
5,344,135 A * 9/1994 Isobe et al. ..... 271/180
5,421,443 A * 6/1995 Hatamachi et al. ..... 194/206
5,632,367 A 5/1997 Bergeron et al.
5,676,366 A * 10/1997 Polidoro ..... 271/180
5,836,435 A * 11/1998 Fujita et al. ..... 194/206
5,876,033 A * 3/1999 Lonati ..... 271/180
5,899,452 A 5/1999 Walsh

FOREIGN PATENT DOCUMENTS

JP 08-241448 9/1996
JP 26-09155 2/1997

* cited by examiner

*Primary Examiner*—John M. Jillions
(74) *Attorney, Agent, or Firm*—Morrison & Foerster LLP

(57) ABSTRACT

Reciprocating unit for reciprocating a pressing plate includes a pair of link mechanisms disposed along opposite sides of the pressing plate. Each of the link mechanisms includes a pair of link members pivotally connected with each other in an intersecting fashion, and at least one of the link members is coupled at one end to the pressing plate for sliding movement therealong. The link mechanisms are interconnected at a predetermined position via a connecting member, and an actuator is operatively connected to the connecting member. The actuator is linearly displaced by a drive unit. The link mechanisms are caused to extend and contract, together as an integral unit, via the connecting member in response to linear reciprocating movement of the actuator.

4 Claims, 3 Drawing Sheets

A
M
M1
11
11a
11b
11b1
12
12a
12a1
12b
13
13a
13b
14
14b1
15
15a
16

PAPER-LIKE-PIECE HANDLING APPARATUS

BACKGROUND OF THE INVENTION

The present invention relates generally to paper-like-piece handling apparatus for storing bills (pieces of paper money) or other paper-like pieces in a storage section using a paper-like-piece-pressing-plate reciprocating unit, and more particularly to a paper-like-piece handling apparatus of a type which includes a paper-like-piece-pressing-plate reciprocating unit composed of extendible/contractible pantograph-type link mechanisms.

There have been known bill handling apparatus for cumulatively storing bills in a bill storage section using a reciprocating unit, one example of which is disclosed in Japanese Patent No. 2609155. The reciprocating unit in the bill handling apparatus disclosed in the Japanese patent permits extraction and contraction of a pair of left and right pantograph-type link mechanisms each comprising a pair of link arms or link members pivotally connected with each other at respective central points in an intersecting fashion. The extraction and contraction of the pantograph-type link mechanisms cause a bill pressing plate to move back and forth (i.e., reciprocate) so as to store a bill into the bill storage section. Specifically, each of the left and right pantograph-type link mechanisms, each including the intersecting link members, has one end pivotally connected to a base plate and bill pressing plate and another end slidably coupled to the base plate and bill pressing plate. Sliding movement of the other end of the pantograph-type link mechanism can cause the pantograph-type link mechanism to extend and contract so that the bill pressing plate can reciprocate. More specifically, for such extraction and contraction of the pantograph-type link mechanism, a sliding actuator plate is connected to the other end of the link mechanism, and rotating movement of a rotary eccentric cam is caused to directly act on the sliding actuator plate in such a manner that the sliding actuator plate moves back and forth in a direction substantially parallel to a surface of the bill. Further, there has been known another type of bill handling apparatus which includes a pair of left and right pantograph-type link mechanisms each provided with a rotary eccentric cam, and rotating movement of these two rotary eccentric cams is caused to directly act on the corresponding link mechanisms so that linear drive forces are applied to the link mechanisms to cause the link mechanisms to extend and contract substantially perpendicularly to a surface of a bill (e.g., U.S. Pat. No. 5,632,367 or Japanese Patent Laid-open Publication No. HEI-8-241448). Further, U.S. Pat. No. 4,678,072 discloses that a pair of left and right pantograph-type link mechanisms are driven by direct contact with a pair of rotary eccentric cams. Moreover, U.S. Pat. No. 5,899,952 discloses a stacker machine that uses no pantograph-type link mechanism.

In cases where the pantograph-type link mechanisms are caused to extend and contract via an electric motor, the motor may be positioned in either one of the following two ways. First, the motor may be placed in a horizontal orientation such that the axis of the motor's rotation shaft extends perpendicularly to the length of the link mechanisms. Second, the motor may be placed in a vertical orientation such that the axis of the motor's rotation shaft extends parallel to the length of the link mechanisms. In the former case (horizontal orientation), the motor is positioned between the two link mechanisms or outwardly of the two link mechanisms so that the axis of the motor's rotation shaft lies parallel to the rotation shaft axes of the eccentric cams. However, if the motor is to be positioned between the two link mechanisms, it would be very difficult to position the motor as desired due to a small space between the link mechanisms. If, on the other hand, the motor is to be positioned outwardly of the two link mechanisms, the overall apparatus size would undesirably increase because the motor protrudes outwardly from the link mechanisms to a considerable degree. In the latter case (vertical orientation), the motor is disposed between the link mechanisms with the axis of the motor's rotation shaft lying at right angles to the rotation shaft axes of the eccentric cams, and thus the motor would not undesirably protrude outwardly from the link mechanisms; however, in order to transmit the motor's rotating movement to the eccentric cams, there is a need to change the direction of the motor's rotating movement by 90° via a bevel gear or the like. To that end, complicated mechanisms or arrangements would be required not only for distributing the motor's rotating movement to the rotary eccentric cams of the link mechanisms but also for maintaining synchronism in the extension and contraction between the link mechanisms, which would greatly complicate the structure of the reciprocating unit. Namely, because of the use of the bevel gears associated with the two link mechanisms, extra mechanisms would be required for allowing the single motor to deliver its rotating movement to the bevel gears as rotational drive forces of a same direction.

SUMMARY OF THE INVENTION

In view of the foregoing, it is an object of the present invention to provide a paper-like-piece handling apparatus which can greatly simplify the structure of a paper-like-piece-pressing-plate reciprocating unit employed therein.

In order to accomplish the above-mentioned object, the present invention provides a paper-like piece handling apparatus which comprises: a pressing plate that presses a paper-like piece; and a reciprocating unit that reciprocates the pressing plate, the reciprocating unit including a pair of link mechanisms disposed along opposite sides of the pressing plate, each of the link mechanisms including a pair of link members pivotally connected with each other in an intersecting fashion, at least one of the link members being coupled at one end to the pressing plate for sliding movement therealong. The reciprocating unit further includes: a connecting member that interconnects the pair of link mechanisms at a predetermined position; an actuator operatively connected to the connecting member; and a drive unit that linearly displaces the actuator. The pair of link mechanisms are caused to extend and contract, together as an integral unit, via the connecting member in response to linear reciprocating movement of the actuator so that the pressing plate reciprocates in response to extension and contraction of the pair of link mechanisms. With such arrangements, the bill handling apparatus of the present invention enables the extension and contraction of the link mechanisms by means of only one actuator and thus can significantly simplify the structure of the paper-like-piece-pressing-plate reciprocating unit. Namely, the present invention can cause the link mechanisms to extend and contract with an extremely simple structure, by eliminating the need for complicated mechanisms or arrangements for distributing the rotating movement of the motor to the two link mechanisms as rotational drive forces of a same direction. As a result, the present invention can greatly simplify the structure of the reciprocating unit.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which.

DETAILED DESCRIPTION OF EMBODIMENTS

Figure 1:
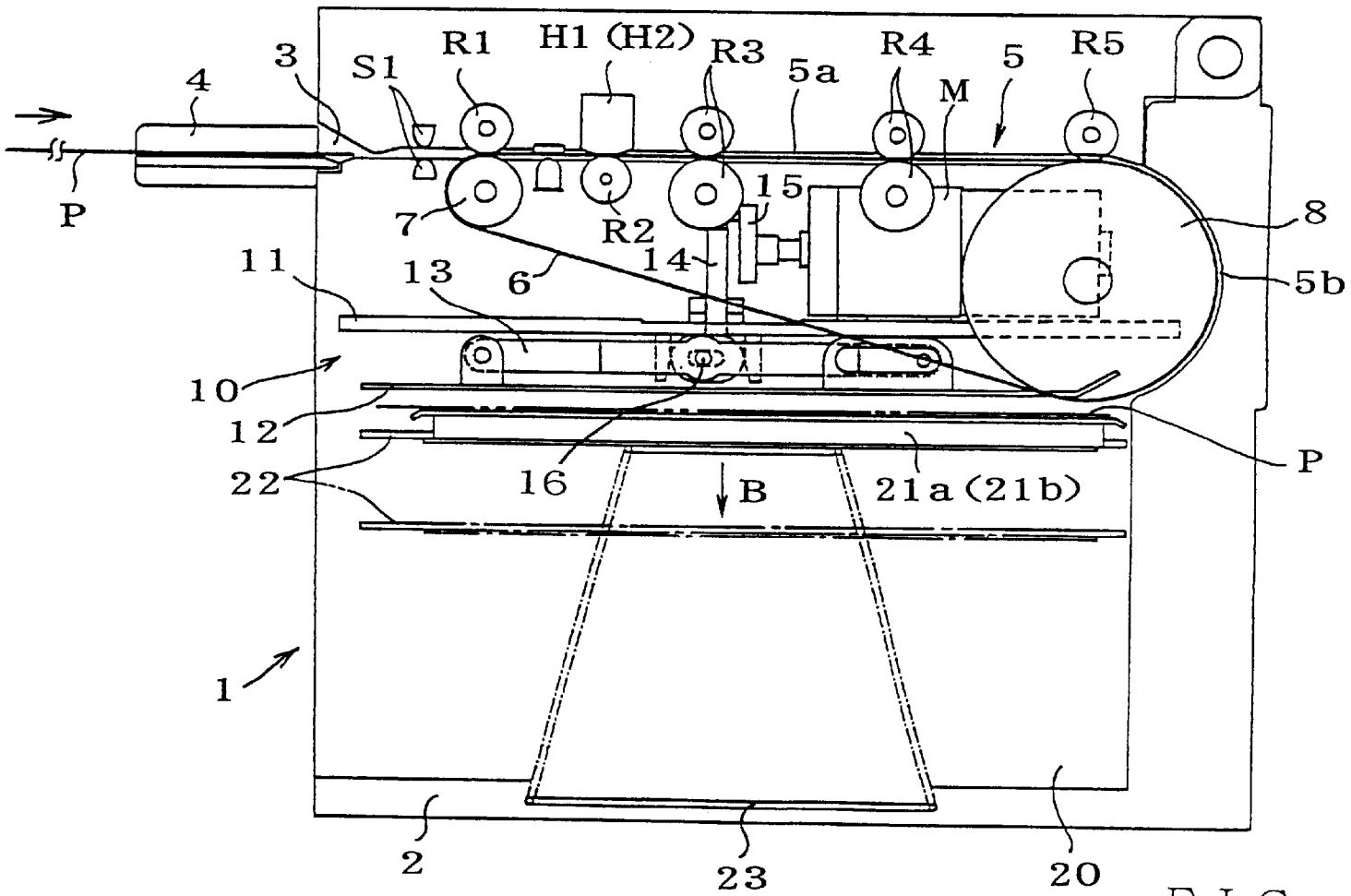
FIG. 1 is a schematic front view showing an internal structure of a bill handling apparatus in accordance with an embodiment of the present invention.

Now, a description will be made about a bill handling apparatus in accordance with one embodiment of the present invention. FIG. 1 is a schematic front view showing an internal structure of the bill handling apparatus. In FIG. 1, the body of the bill handling apparatus 1 includes a casing 2 substantially in the shape of a hollow cube (i.e., having six substantially equal sides). Bill inserting slot 3 is formed in an upper portion of a front wall (left wall in the figure) of the casing 2. Bill P is longitudinally inserted into the interior of the handling apparatus through the bill inserting slot 3 while being guided along a bill insertion guide 4 leading to the inserting slot 3. Within the casing 2, there is provided a bill passageway 5 communicating with the bill inserting slot 3 for carrying the inserted bill P in the longitudinal direction of the bill P. The bill passageway 5 includes a linear transfer section 5*a* for linearly carrying the bill P, and an inverting transfer section 5*b* for turning over the bill P, transferred from the linear transfer section 5*a*, by 180 degrees (i.e., inside out) while the bill P is carried along a circular surface of the section 5*b*. In proximity to the linear transfer section 5*a*, there are provided a pair of magnetic heads H1 and H2 for validating or testing authenticity of the bill P. More specifically, the magnetic heads H1 and H2 are disposed to the left and right of a longitudinal center line (located in the middle in the widthwise direction of the bill passageway 5) of the passageway 5, so as to detect magnetic components contained in ink with which the bill P was printed. Further, a bill sensor S1 is provided near the bill inserting slot 3 for detecting insertion, into the slot 3, of the bill P.

The bill passageway 5 is composed of a pair of bill conveying belts 6, an electric motor (not shown) for driving the bill conveying belts 6, and two pulleys 7 and 8 of different diameters for transmitting the rotating movement of the motor to the bill conveying belts 6. The smaller-diameter pulley 7 is disposed in relation to the linear transfer section 5*a*, while the greater-diameter pulley 8 is disposed in relation to the inverting transfer section 5*b*. The bill conveying belts 6 are each wound on and extend between the two pulleys 7 and 8 under tension along the linear transfer section 5*a* and inverting transfer section 5*b*. Thus, the bill P is subjected to a drive force by the bill conveying belts 6. Note that reference characters R1, R2, R3, R4 and R5 represent follower rollers positioned along the bill conveying belts 6 at predetermined intervals.

Below the linear transfer section 5*a* of the bill passageway 5, there is provided a stacker unit 10 for cumulatively storing a multiplicity of the bills P, transferred one by one from the inverting transfer section 5*b*, in a bill storage section 20 in a stacked fashion. As shown in FIG. 1 and FIGS. 2A, 2B and 2C, the stacker unit 10 includes a base plate 11 secured to the casing 2, a pressing plate 12 for pressing the bill P in a direction substantially perpendicular to the surface of the bill P, and a pair of pantograph-type extendible/contractible link mechanisms 13 for reciprocating the pressing plate 12 in the direction substantially perpendicular to the surface of the bill P. The two link mechanisms 13 are identical in construction but operatively interconnected in a manner as will be later described in detail. The stacker unit 10 also includes an actuator lever 14 for causing the pair of pantograph-type extendible/contractible link mechanisms 13 to extend and contract in response to rotation of an actuator motor M covered with a gear-case and mounted on the obverse side or upperside of the base plate 11, and a rotary eccentric cam 15 for causing the rotating movement of the actuator motor M to act directly on the actuator lever 14 so that the actuator lever 14 moves linearly in the direction substantially perpendicular to the surface of the bill P.

Figure 2A:
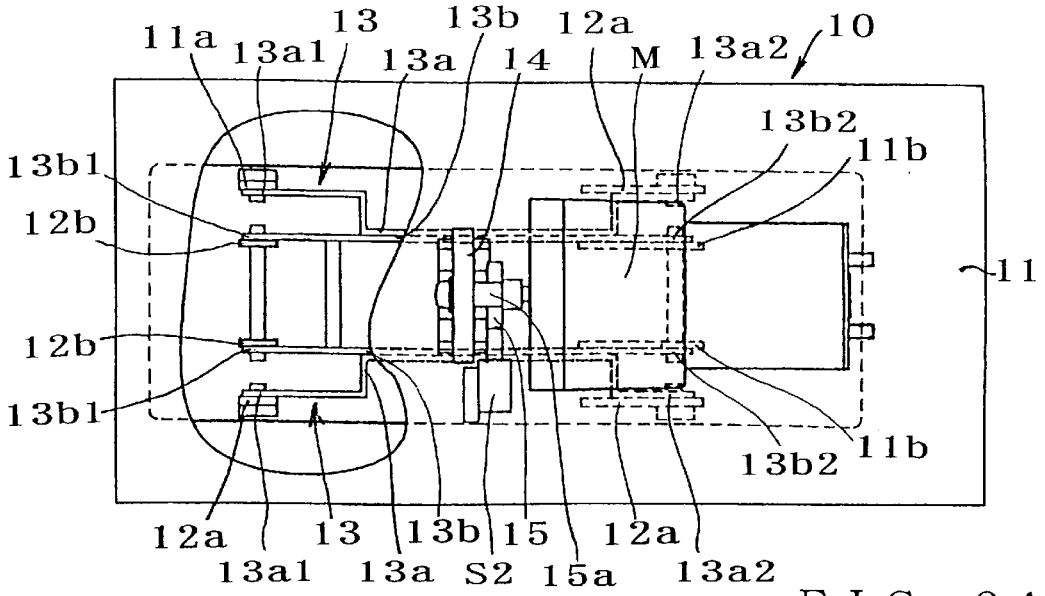
FIG. 2A is a plan view, with parts cut away, of the bill handling apparatus, which schematically shows a general structure of a stacker unit of the bill handling apparatus.

The pressing plate 12 is connected to the reverse side or underside of the base plate 11 via the link mechanisms 13 opposed to each other in a widthwise direction of the bill P, as seen in FIG. 2A. Each of the pantograph-type link mechanisms 13 includes a pair of outer and inner link members 13*a* and 13*b* that are pivotally connected with each other, via a connecting shaft 16, at their respective central positions where the links 13*a* and 13*b* intersect with each other. In each of the pantograph-type link mechanisms 13, the outer link member 13*a* has its opposite end portions bent outwardly away from the corresponding inner link member 13*b* and then extending parallel to end portions of the inner link member 13*b*. The outer link member 13*a* is pivotally supported at one end 13*a*1 by a bearing piece 11*a* provided on the reverse or underside of the base plate 11, and is slidably supported or fitted at the other end 13*a*2 in an horizontal elongated hole 12*a*1 formed in a support member 12*a* that is provided on the upperside of the pressing plate 12. The inner link member 13*b*, on the other hand, is pivotally supported at one end 13*b*1 by a bearing piece 12*b* provided on the upperside of the pressing plate 12, and is slidably fitted at the other end 13*b*2 in an horizontal elongated hole 11*b*1 formed in a support member 11*b* that is provided on the underside of the base plate 11. Each of the horizontal elongated holes 12*a*1 and 11*b*1 extends along the longitudinal direction of the bill P, namely, the pressing plate 12. Each of the pantograph-type link mechanisms 13 extends and contracts as the outer and inner link members 13*a* and 13*b* pivot about the connecting shaft 16 toward and away from each other, between contracted and extended positions, with the other ends 13*a*2 and 13*b*2 of the links 13*a* and 13*b* sliding along the respective horizontal elongated holes 12*a*1 and 11*b*1 in the longitudinal direction of the pressing plate 12. During that time, the connecting shaft 16 slightly moves along with the sliding movement of the other ends 13*a*2 and 13*b*2 of the outer and inner link members 13*a* and 13*b*, as will be later described.

Figure 2B:
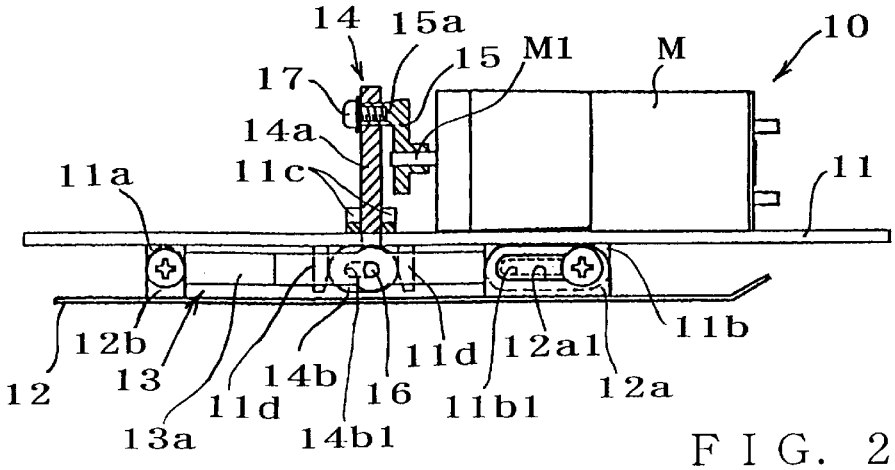
FIG. 2B is a front view, with parts cut away, of the stacker unit.
Figure 2C:
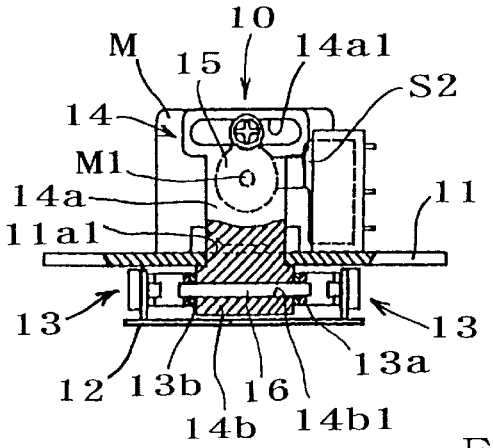
FIG. 2C a left side view, with parts cut away, of the stacker unit.

As shown in FIGS. 2B and 2C, the actuator lever 14 has a flat plate section 14*a* operatively coupled with the eccentric cam 15, and a substantially oval coupling section 14*b* operatively coupled with the connecting shaft 16 and located on the underside of the base plate 11. The flat plate section 14*a* has a lower end portion extending through a hole formed in a longitudinally-central portion of the base plate 11 in such a manner that it is movable in the direction substantially perpendicular to the surface of the bill P. Horizontal elongated hole 14*b*1 is formed through the coupling section 14*b* in a lateral (widthwise) direction of the pressing plate 12, and this through-hole 14*b*1 extends in the longitudinal direction of the pressing plate 12. The connecting shaft 16 is loosely fitted in the through-hole 14*b*1 so that the shaft 16 is movable in the longitudinal direction of the pressing plate 12. In this way, the connecting shaft 16 is allowed to move within and along the through-hole 14*b*1 in the longitudinal direction of the pressing plate 12 as the other ends 13*a*2 and 13*b*2 of the outer and inner link members 13*a* and 13*b* slide along the respective horizontal elongated holes 12*a* 1 and 12*b* 1. This arrangement permits smooth extension/contraction of the pair of the pantograph-type link mechanisms 13.

In an upper portion of the flat plate section 14*a* extending upward from the upperside of the base plate 11, there is formed a horizontal elongated hole 14*a*1 extending in the widthwise direction of the pressing plate 12, and the eccentric cam 15 is coupled with the flat plate section 14*a* by means of an eccentric pin 15*a* extending from the cam 15 and loosely fitted in the elongated hole 14*a*1. More specifically, the eccentric pin 15*a* is provided on and protrudes from the eccentric cam 15 at a predetermined distance from the rotation shaft M1 of the actuator motor M functioning as a rotational center of the eccentric cam 15. The eccentric pin 15*a* moves along the elongated hole 14*a*1 as the eccentric cam 15 is driven to rotate via the actuator motor M. Thus, via the eccentric pin 15*a*, the rotating movement of the eccentric cam 15 causes the actuator lever 14 to move in the direction substantially perpendicular to the surface of the bill P. At the distal end of the eccentric pin 15*a*, there may be provided a slip-out preventing means 17, such as a screw or projection, for preventing the eccentric pin 15*a* from accidentally slipping out of the elongated hole 14*a*1 formed in the flat plate section 14*a*. A pair of guide members 11*c* are provided on or near the upperside of the base plate 11 for guiding the flat plate section 14*a* of the actuator lever 14 in such a manner that the flat plate section 14*a* can be reliably prevented from tilting in the longitudinal direction of the bill P. Further, another pair of guide members lid are provided on or near the underside of the base plate 11 for guiding the coupling section 14*b* of the actuator lever 14 in such a manner that the coupling section 14*b* can be reliably prevented from swinging in the longitudinal direction of the bill P when the pantograph-type link mechanisms 13 are placed in the contracted position.

As further shown in FIG. 1, the bill storage section 20 is disposed below the stacker unit 10, which receives each bill P pressed downward by the pressing plate 12 of the stacker unit 10 and thereby cumulatively stores therein a multiplicity of the bills P in a stacked state. More specifically, the bill storage section 20 has a bill-storing inlet opening (not shown) formed by a pair of horizontal elongated bill-receiving channel members 21*a* and 21*b* that are opposed to each other in the widthwise direction of the bill P with a predetermined space therebetween slightly smaller than the width of the bill P. In addition, a bill compressing plate 22 having a size corresponding to the size or area of the bill P is provided in parallel relation to the channel members 21*a* and 21*b* and pressing plate 12. Whereas the channel members 21*a* and 21*b* are secured to the casing 2, the bill compressing plate 22 is normally urged via a spring 23 toward the pressing plate 12 and can be translated toward the pressing plate 12 in the direction substantially perpendicular to the surface of the bill P pressed by the pressing plate 12.

Figures 3A, 3B, 3C, 3D, 3E, 3F:
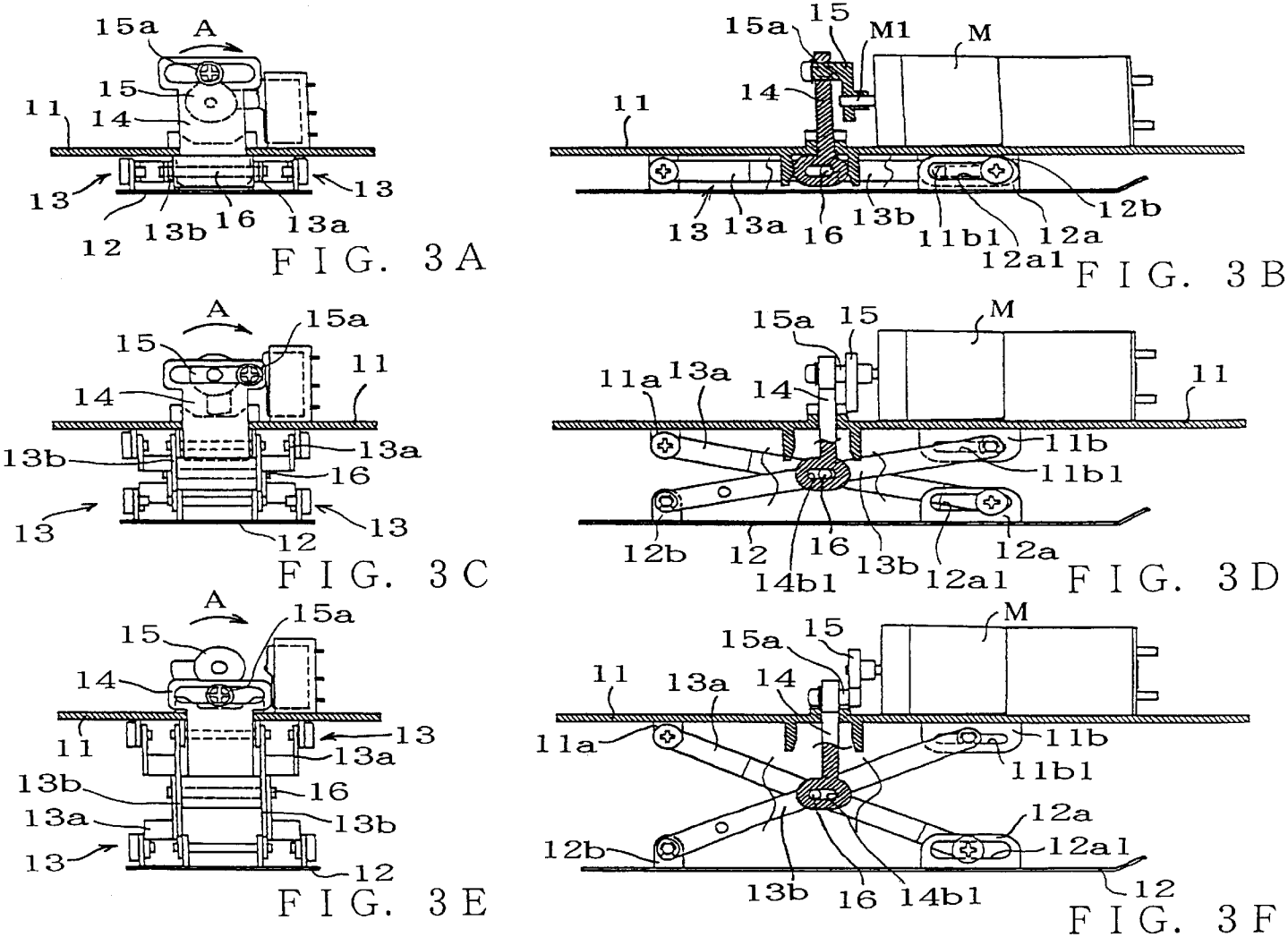
FIGS. 3A and 3B are views explanatory of operation in a standby state of the stacker unit.
FIGS. 3C and 3D are views explanatory of a manner in which a pressing plate of the stacker unit is depressed.
FIGS. 3E and 3F are views showing the pressing plate of the stacker unit having been depressed to a maximum extent.

In FIGS. 1, 3A and 3B, the stacker unit 10 is shown as being in a standby state where the pressing plate 12 is located remotest or farthest from the bill storage section 20. In the standby state, a gap between the pressing plate 12 and the channel members 21*a* and 21*b* constitutes a bill passageway, as best seen in FIG. 1. Once insertion of the bill P into the bill inserting slot 3 is detected by the above-mentioned bill sensor S1, the bill-transferring motor is caused to rotate in a forward direction so as to carry the inserted bill P in a forward direction along the bill passageway 5, during which time the authenticity of the inserted bill P is tested on the basis of the outputs from the magnetic heads H1 and H2. In case the inserted bill P has been determined as a "false bill", the bill-transferring motor is caused to rotate in a reverse direction in order to immediately reject or return the bill P. If the inserted bill P has been determined as a "genuine bill", on the other hand, the forward rotation of the bill-transferring motor is terminated upon lapse of a predetermined time, so that the bill P is stopped at a position corresponding to the pressing plate 12. Then, the actuator motor M is caused to rotate in a forward direction so that a bill accumulating operation is performed for cumulatively storing each inserted bill P. Bill-carrying switch S2 (FIGS. 2A and 2C) is provided on the pressing plate 12 in order to perform control for causing the actuator motor M to rotate during the bill accumulating operation. The eccentric cam 15 is caused to make one turn or rotation by the rotation of the actuator motor M so that the pressing plate 12 makes one reciprocating movement toward and away from the bill P.

As the eccentric cam 15 makes one quarter (¼) turn in a direction of arrow A by the rotation of the actuator motor M while the stacker unit 10 is in the standby state, the eccentric pin 15*a* moves along the elongated hole 14*a*1 from the longitudinally-central portion to the right end (FIG. 3A) of the hole 14*a*1 while depressing the actuator lever 14. FIG. 3C shows a state of the stacker unit 10 when the eccentric cam 15 has made the ¼ turn, and FIG. 3D shows a manner in which the pressing plate 12 is depressed by the ¼ turn of the eccentric cam 15. Namely, in this state, the actuator lever 14 presses the connecting shaft 16, connecting between the link mechanisms 13, downwardly from the positions shown in FIGS. 3A and 3B, in response to which the other ends 13*a*2 and 13*b*2 of the outer and inner link members 13*a* and 13*b* in each of the link mechanisms 13 slide along the respective horizontal elongated holes 12*a*1 and 12*b*1 from the right end toward the left end (FIG. 3D) of the holes 12*a*1 and 12*b*1. Accordingly, the outer and inner link members 13*a* and 13*b* in each of the link mechanisms 13 are caused to pivot with respect to each other, about the connecting shaft 16, into an opened position so that the pantograph-type link mechanisms 13 are brought to the extended position. During that time, the connecting shaft 16 also moves along the through-hole 14*b*1 in the coupling section 14*b* of the actuator lever 14 from the right end toward the left end of the through-hole 14*b*1. By the pantograph-type link mechanisms 13 being thus brought to the extended position, the pressing plate 12 moves closer to the bill compressing plate 22 of FIG. 1 to thereby press the bill P against the compressing plate 22.

As the eccentric cam 15 further makes a half (½) turn, from the position of FIG. 3C, in the arrow A direction by a further forward rotation of the actuator motor M, the eccentric pin 15*a* moves along the laterally elongated hole 14*a*1 from the right end to the longitudinally-central portion of the hole 14*a*1 while depressing the actuator lever 14. FIG. 3E shows a state of the stacker unit 10 when the eccentric cam 15 has made the half (½) turn, and FIG. 3F shows the pressing plate 12 having been depressed to a maximum extent by the half turn of the eccentric cam 15. Namely, in this state, the actuator lever 14 presses the connecting shaft 16, connecting between the link mechanisms 13, further downwardly from the positions shown in FIG. 3D, in response to which the other ends 13*a*2 and 13*b*2 of the outer and inner link members 13*a* and 13*b* in each of the link mechanisms 13 further slide along the respective horizontal elongated holes 12*a*1 and 11*b*1 toward the left end of the holes 12*a*1 and 11*b*1. Accordingly, the outer and inner link members 13*a* and 13*b* in each of the link mechanisms 13 are caused to further pivot with respect to each other, about the connecting shaft 16, into a further opened position so that the pantograph-type link mechanisms 13 are brought to a further extended position. During that time, the connecting shaft 16 also moves along the through-hole 14*b*1 from the position of FIG. 3D further toward the left end of the through-hole 14*b*1. By the pantograph-type link mechanisms 13 being thus brought to the further extended position, the pressing plate 12 moves further closer to the bill compressing plate 22 of FIG. 1 and then passes through the bill-storing inlet opening (not shown) formed by the opposed channel members 21*a* and 21*b* while still pressing the bill P, so that the bill P passes through the bill-storing inlet opening while being bent by the opposed channel members 21*a* and 21*b*. Thus, the pressing plate 12 depresses the bill compressing plate 22 in a direction of arrow B (FIG. 1) against the bias of the spring 23 while pressing the bill P against the compressing plate 22. Thus, a gap is formed between the channel members 21*a* and 21*b* and the bill compressing plate 22, and the bill P pressed by the pressing plate 12 is introduced into the gap.

Then, as the eccentric cam 15 further makes the remaining half (½) turn in the arrow A direction by a further forward rotation of the actuator motor M, the eccentric pin 15*a* moves along the elongated hole 14*a*1 from the longitudinally-central portion to the left end of the hole 14*a*1 while upwardly pressing the actuator lever 14, after which the eccentric pin 15*a* returns from the left end to the longitudinally-central portion of the elongated hole 14*a*1. During that time, the connecting shaft 16, connecting between the link mechanisms 13, is pressed upward, in response to which the other ends 13*a*2 and 13*b*2 of the outer and inner link members 13*a* and 13*b* in each of the link mechanisms 13 slide along the respective horizontal elongated holes 12*a*1 and 11*b*1 from the left end toward the right end of the holes 12*a*1 and 11*b*1. Accordingly, the outer and inner link members 13*a* and 13*b* in each of the link mechanisms 13 are caused to pivot with respect to each other, about the connecting shaft 16, into a closed position so that the pantograph-type link mechanisms 13 are brought to a contracted position. During that time, the connecting shaft 16 also moves along the through-hole 14*b*1 from the left end toward the right end of the through-hole 14*b*1. By the pantograph-type link mechanisms 13 being thus brought to the contracted position, the pressing plate 12 moves back to the position shown in FIGS. 3A and 3B, so that the bill compressing plate 22 is pressed toward the opposed channel members 21*a* and 21*b* via the bias of the spring 23. This way, the opposite sides edge portions of the bill P abuts against the channel members 21*a* and 21*b* and thus the upward movement of the bill compressing plate 22 is stopped, so that a plurality of the bills P are held between the channel members 21*a* and 21*b* and the compressing plate 22 in compressed condition. In this manner, a multiplicity of the bills P can be stored in the bill storage section 20 in a stacked state.

Whereas the bill handling apparatus 1 of the invention has been described as employing the stacker unit 10 where the rotating movement of the actuator motor M is converted via the eccentric cam 15 into linear reciprocating movement of the actuator lever 14, the combination of the actuator motor M and eccentric cam 15 may be replaced by a linear motor; that is, the actuator lever 14 may be caused via the linear motor to make the linear reciprocating movement. Further, in each of the pantograph-type link mechanisms 13, the pair of the outer and inner link members may be slidably coupled at both ends to the base plate 11 and pressing plate 12. Further, the present invention is applicable to handling of any other desired paper-like pieces than bills (pieces of paper money), such as gift vouchers and other types of vouchers, certificates of stock, bills of exchange and checks.

In summary, the bill handling apparatus of the present invention enables the extension and contraction of the link mechanisms by means of only one actuator and thus can significantly simplify the structure of the paper-like-piece-pressing-plate reciprocating unit.

What is claimed is:

1. A paper-like piece handling apparatus comprising:

a pressing plate that presses a paper-like piece; and a reciprocating unit that reciprocates said pressing plate, said reciprocating unit including a pair of link mechanisms disposed along opposite sides of said pressing plate, each of said link mechanisms including a pair of link members pivotally connected with each other in an intersecting fashion, at least one of said link members being coupled at one end to said pressing plate for sliding movement therealong, wherein said reciprocating unit further includes:

a connecting member that interconnects said pair of link mechanisms at a predetermined position;

an actuator operatively connected to said connecting member; and a drive unit that linearly displaces said actuator, whereby said pair of link mechanisms are caused to extend and contact, together as an integral unit, via said connecting member in response to linear reciprocating movement of said actuator so that said pressing plate reciprocates in response to extension and contraction of said pair of link mechanisms, wherein said actuator is connected at one end to said drive unit and is loosely coupled at another end to said connecting member, said drive unit displaces said actuator linearly in a direction substantially perpendicular to a surface of the paper-like piece.

2. A paper-like piece handling apparatus as claimed in claim 1 wherein said link mechanisms are interconnected via said connecting member at a point where said pair of link members in each of said link mechanisms intersect with each other.

3. A paper-like piece handling apparatus as claimed in claim 1 wherein said drive unit includes a motor and a cam mechanism that converts rotating movement of said motor into linear movement of said actuator.

4. A paper-like piece handling apparatus as claimed in claim 1 which further comprises a transfer mechanism that carries the paper-like piece to a predetermined position for being pressed by said pressing plate, and a storage section that stores therein the paper-like piece pressed by said pressing plate.

* * * * *